US009260216B1

(12) United States Patent
Costanzo, Jr.

(10) Patent No.: US 9,260,216 B1
(45) Date of Patent: Feb. 16, 2016

(54) BOX DESIGN, BLANK AND METHODS

(71) Applicant: THATBOX DESIGN, LLC, Fort Mill, NC (US)

(72) Inventor: Donn J. Costanzo, Jr., Fort Mill, SC (US)

(73) Assignee: THATBOX DESIGN, LLC, Fort Mill, SC (US)

( * ) Notice: Subject to any disclaimer, the term of this patent is extended or adjusted under 35 U.S.C. 154(b) by 0 days.

(21) Appl. No.: 14/318,574

(22) Filed: Jun. 27, 2014

Related U.S. Application Data

(60) Provisional application No. 61/840,460, filed on Jun. 27, 2013.

(51) Int. Cl.
*B65D 5/36* (2006.01)
*B65D 5/66* (2006.01)
*B65D 5/68* (2006.01)

(52) U.S. Cl.
CPC ..... *B65D 5/6602* (2013.01); *B65D 5/3678* (2013.01); *B65D 5/6626* (2013.01); *B65D 5/68* (2013.01)

(58) Field of Classification Search
USPC ..... 229/117.06, 117.05, 117.01
See application file for complete search history.

(56) References Cited

U.S. PATENT DOCUMENTS

| | | | | |
|---|---|---|---|---|
| 5,305,949 | A * | 4/1994 | Linden | 229/117.01 |
| 7,367,490 | B2 * | 5/2008 | Forthaus et al. | 229/117.24 |
| 7,841,512 | B2 * | 11/2010 | Westerman et al. | 229/125.28 |
| 2010/0140333 | A1 * | 6/2010 | McDonald et al. | 229/117.01 |

* cited by examiner

*Primary Examiner* — Christopher Demeree
(74) *Attorney, Agent, or Firm* — Tillman Wright, PLLC; Chad D. Tillman; Jeremy C. Doerre

(57) ABSTRACT

Box designs, blanks for forming boxes by folding, collapsible and non-collapsible boxes formed thereby, and manufacturing methods therefor are disclosed. An exemplary box is formed from folding a single sheet of material having fold lines therein. The assembled box includes a lid comprising a top panel having top side panels that extend partially within the interior of the box and partially on the exterior of the box when the box is assembled and the lid is closed. Overlapping side panels of the box define openings through which the top side panels extend in crossing over from the exterior of the box to the interior of the box. In a feature, the openings defined in the sides of the box are covered by the top side panels when extending therethrough. In another feature, the box is collapsible when in the assembled state.

20 Claims, 21 Drawing Sheets

FIG. 10
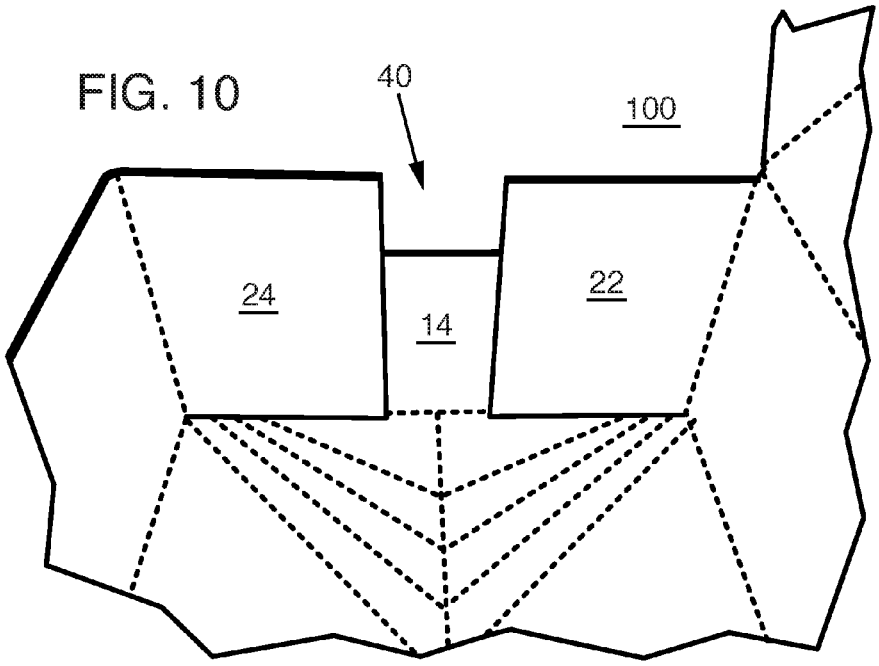
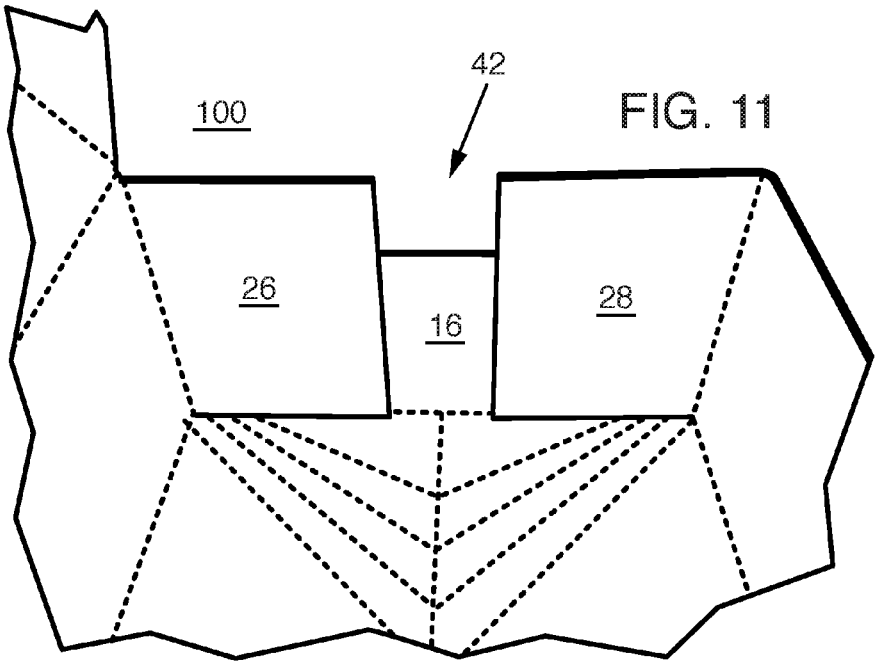
FIG. 11

BOX DESIGN, BLANK AND METHODS

CROSS-REFERENCE TO RELATED APPLICATION

The present application is a nonprovisional of, and claims the benefit under 35 U.S.C. §119(e) to, U.S. provisional patent application 61/840,460 filed Jun. 27, 2013, which is hereby incorporated herein by reference in its entirety.

COPYRIGHT STATEMENT

All of the material in this patent documents is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to box designs, blanks for forming boxes by folding, collapsible and non-collapsible boxes formed thereby, and manufacturing methods therefor.

SUMMARY OF THE INVENTION

The present invention includes many aspects and features. In one aspect of the invention, a box is formed from folding a single sheet of material having fold lines therein. The assembled box includes a lid comprising a top panel having top side panels that extend partially within the interior of the box and partially on the exterior of the box when the box is assembled and the lid is closed. Overlapping side panels of the box define openings through which the top side panels extend in crossing over from the exterior of the box to the interior of the box. In a feature, the openings defined in the sides of the box are covered by the top side panels when extending therethrough. In another feature, the box is collapsible when in the assembled state.

Another aspect comprises a box blank for making the above-described box by folding of the box blank along fold lines formed in the box blank.

Another aspect comprises a method of making the above-described box from a box blank by folding of the box blank along fold lines formed in the box blank.

Additional aspects and features are disclosed below and in the drawings.

BRIEF DESCRIPTION OF THE DRAWINGS

One or more preferred embodiments of the present invention now will be described in detail with reference to the accompanying drawings.

FIG. 10 is a perspective view of the second side of the assembled box 100 from inside of the box, wherein the cover is open.

FIG. 11 is a perspective view of the second side of the assembled box 100 from inside of the box, wherein the cover is open.

DETAILED DESCRIPTION

Figure 1:
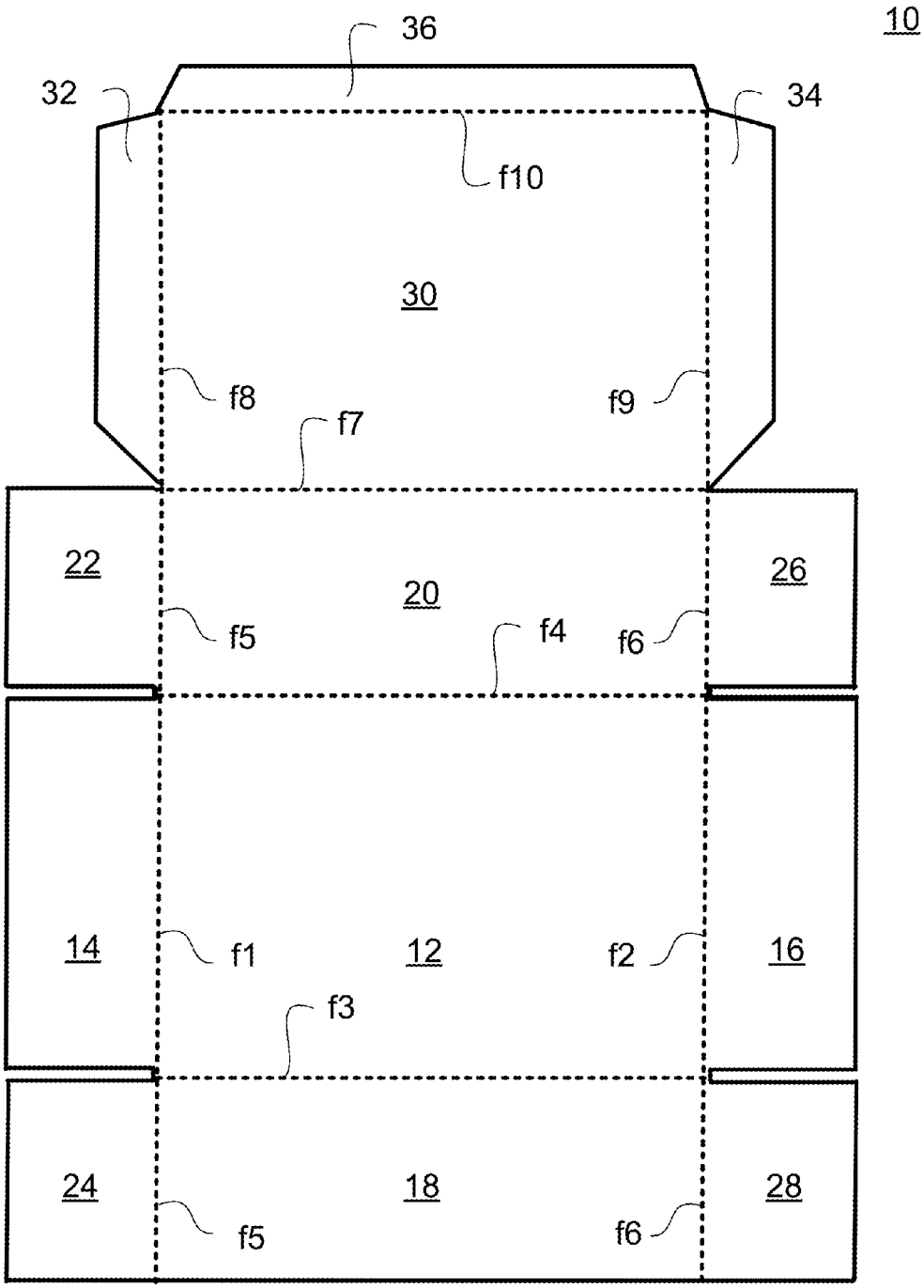
FIG. 1 is a plan view of a preferred embodiment of a box blank 10 in accordance with an aspect of the invention.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, three preferred embodiments 100,200,300 of the present invention are shown. The following description of one or more preferred embodiments is merely exemplary in nature and is in no way intended to limit the invention, its implementations, or uses.

Turning now to FIG. 1, a preferred embodiment of a box blank 10 in accordance with an aspect of the invention is illustrated. The box blank 10 comprises a bottom panel 12; a first side panel 14; a second side panel 16; a front panel 18; a back panel 20; a first overlapping side panel 22; a second overlapping side panel 24; a third overlapping side panel 26; and a fourth overlapping side panel 28. The box blank 10 further comprises a top cover panel 30; a first top side panel 32; a second top side panel 34; and a top front panel 36. The top cover panel 30 and top side panels 32,34 and top front panel form a lid of the box 100.

The panels of the box blank 10 are integrally formed as part of a generally planar single sheet of material, such as cardboard, and are defined and separated by fold lines. The panels so defined and separated are folded relative to each other about such fold line during assembly of a box from the blank 10. In this respect, a "blank" is considered to be a box in an unassembled, flat condition, with the box being assembled by folding of the blank.

In particular, fold line f1 extends between and delineates bottom panel 12 and first side panel 14; fold line f2 extends between and delineates bottom panel 12 and second side panel 16; fold line f3 extends between and delineates bottom panel 12 and front panel 18; fold line f4 extends between and delineates bottom panel 12 and back panel 20.

Additionally, fold line f5 extends between and delineates back panel 20 and first overlapping side panel 22; fold line f6 extends between and delineates back panel 20 and third overlapping side panel 26; fold line f7 extends between and delineates front panel 18 and second overlapping side panel 24; fold line f6 extends between and delineates front panel 18 and fourth overlapping side panel 28.

Fold line f7 extends between and delineates top cover panel 30 and back panel 20; fold line f8 extends between and delineates top cover panel 30 and first top side panel 32; fold line f9 extends between and delineates top cover panel 30 and second top side panel 34; fold line f10 extends between and delineates top cover panel 30 and top front panel 36.

Figure 2:
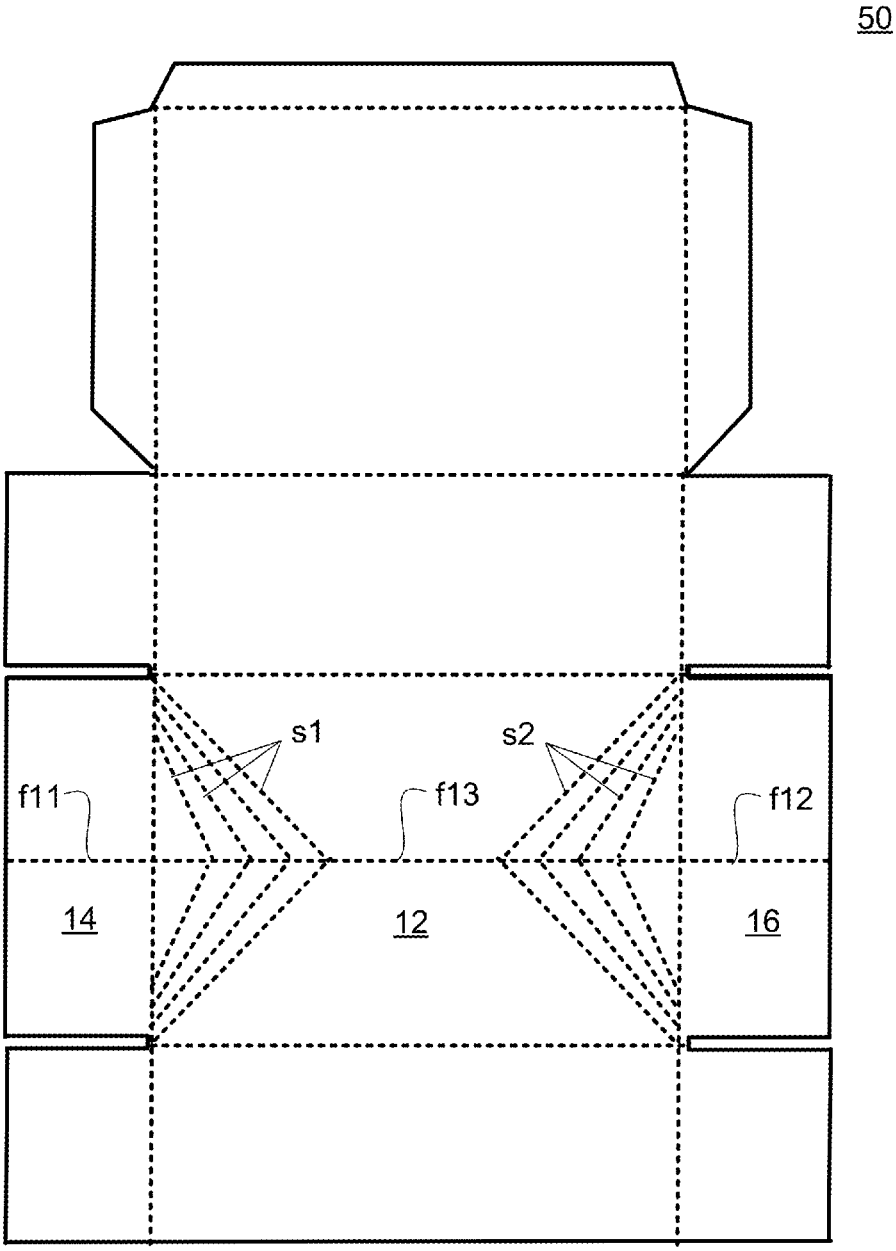
FIG. 2 is a plan view of a preferred embodiment of another box blank 50 in accordance with an aspect of the invention.

FIG. 2 illustrates a preferred embodiment of another box blank 50 in accordance with an aspect of the invention. The box blank 50 is the same as box blank 10 except that box blank 50 includes a fold line f11 generally bisecting side panel 14; a fold line f12 generally bisecting side panel 16; a folding line f13 generally bisecting bottom panel 12; and minor score lines s1 and minor score lines s2. It will be appreciated by the Ordinary Artisan that these additional fold lines and score lines enable a box assembled from folding of the box blank 50 to be collapsed for storage and transport while in the assembled state.

FIGS. 3 through 11 show an embodiment of a box 100 assembled from a box blank that is represented by box blank 50.

Figure 3:
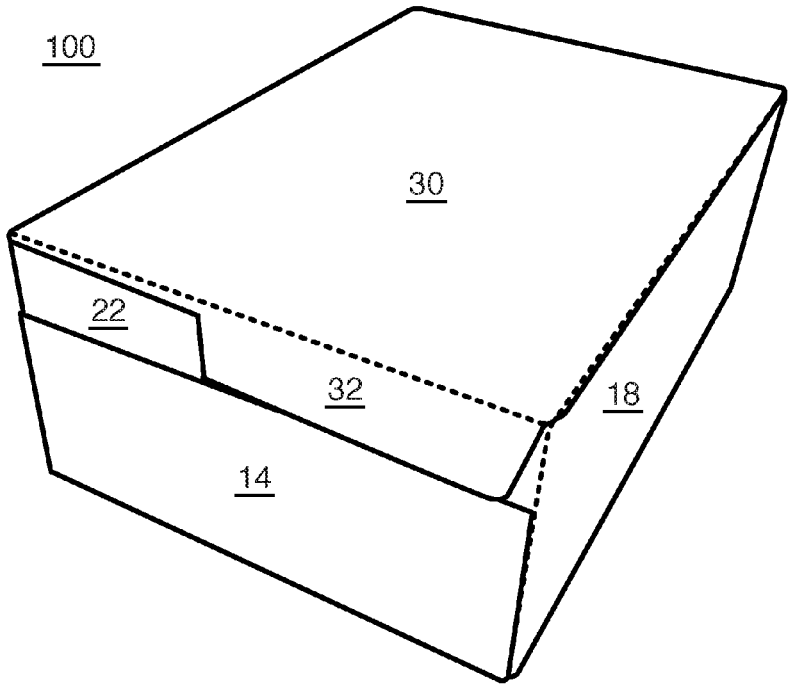
FIG. 3 is a perspective view of an assembled box 100 wherein the cover is closed.

Specifically, FIG. 3 is a perspective view of the assembled box 100 wherein the cover is closed.

Figure 4:
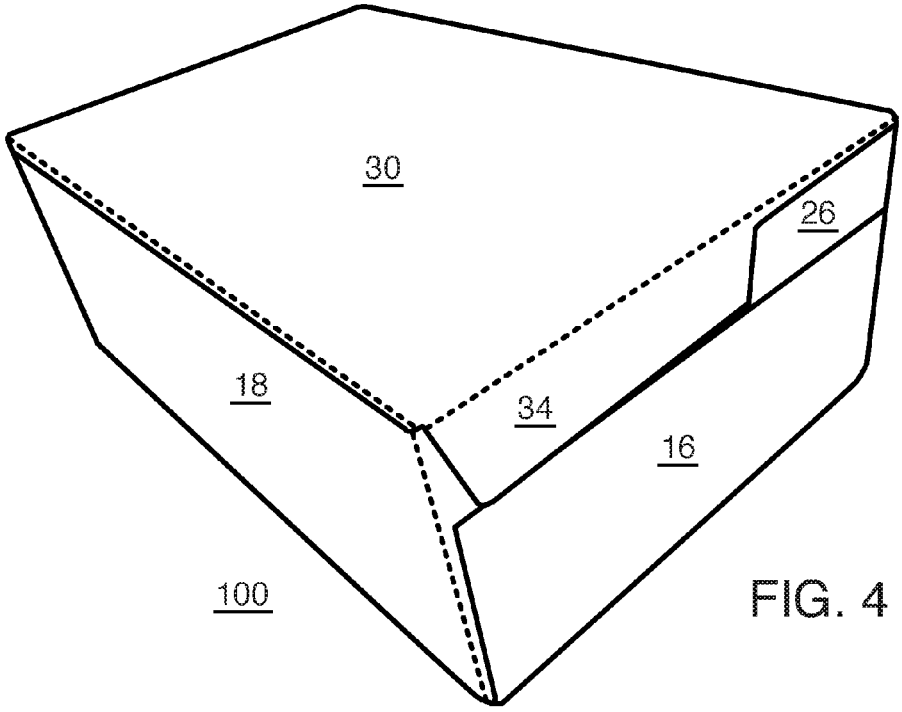
FIG. 4 is a perspective view of a first side of the assembled box 100 wherein the cover is closed.
Figure 5:
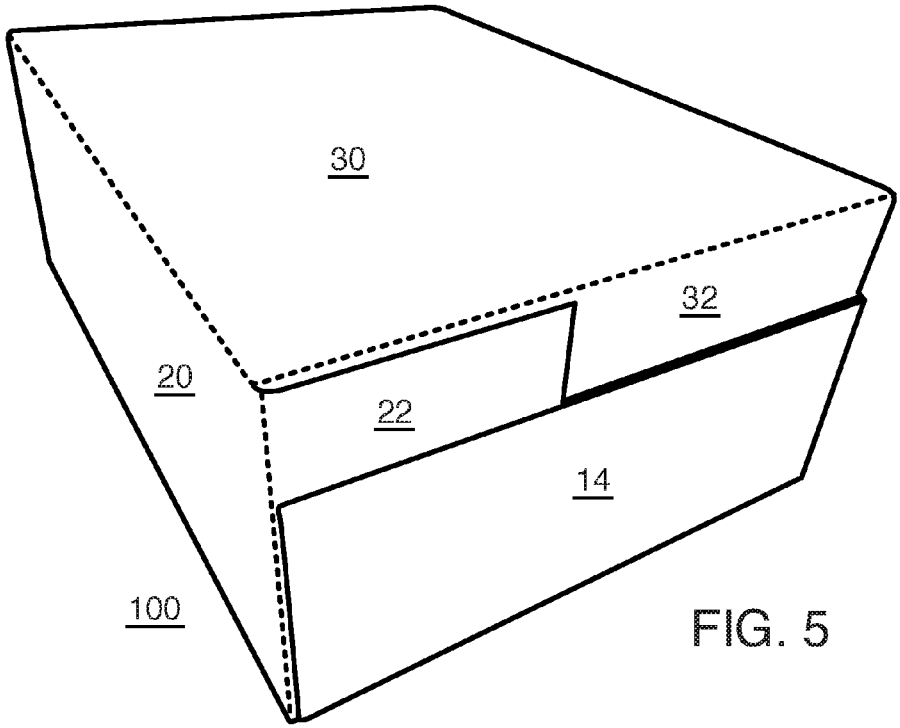
FIG. 5 is a perspective view of a second, opposite side of the assembled box 100 wherein the cover is closed.

FIGS. 4 and 5 are additional perspective views of the assembled box 100 wherein the cover is closed; FIG. 4 is a perspective view of a first side of the box 100 and FIG. 5 is a perspective view of a second, opposite side of the box 100.

Figure 6:
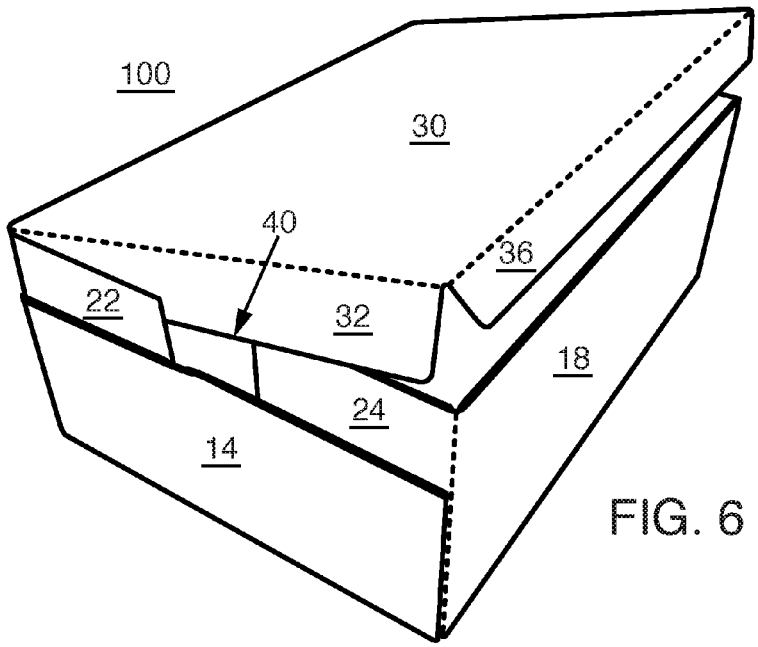
FIG. 6 is a perspective view of the second side of the assembled box 100 wherein the cover is partially closed.
Figure 7:
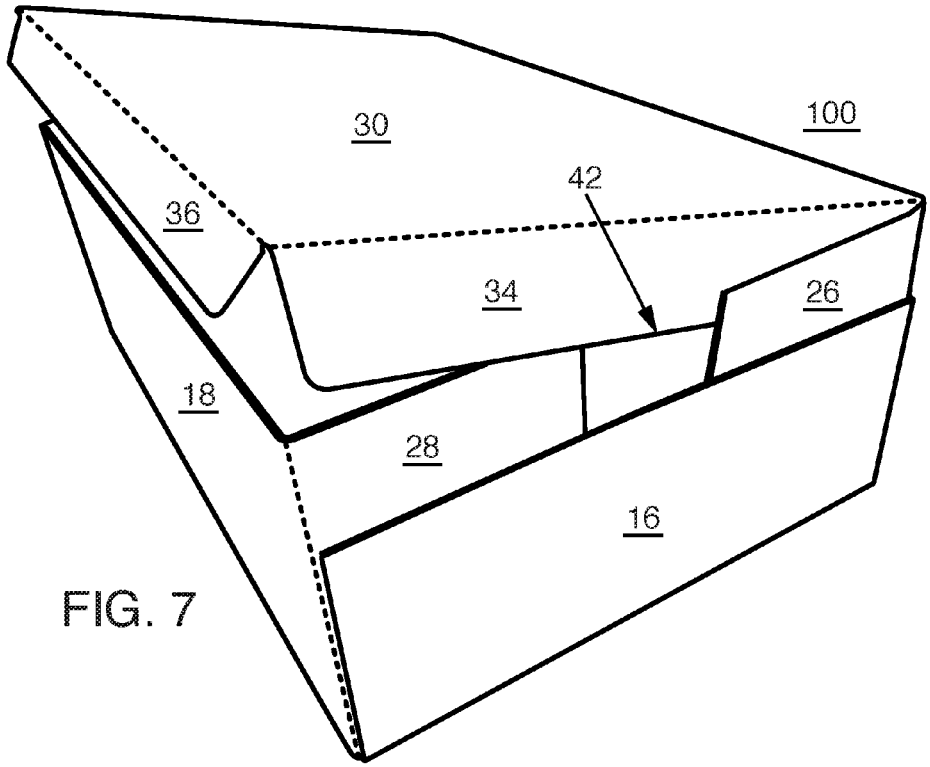
FIG. 7 is a perspective view of the first side of the assembled box 100 wherein the cover is partially closed.

FIGS. 6 and 7 are additional perspective views of the assembled box 100 wherein the cover is partially closed; FIG.

6 is a perspective view of the second side of the box 100 and FIG. 7 is a perspective view of the first side of the box 100.

Figure 8:
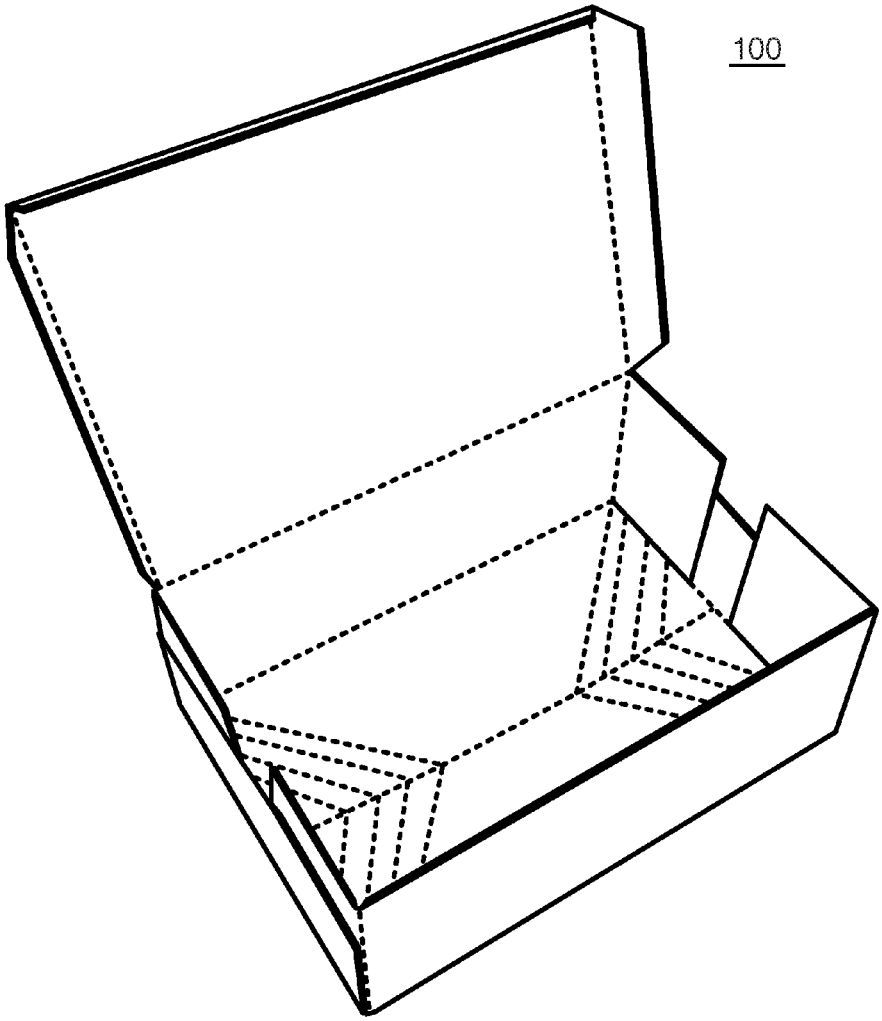
FIG. 8 is a perspective view of the assembled box 100 wherein the cover is open and the box is configured to receive one or more articles therein.

FIG. 8 is a perspective view of the assembled box 100 wherein the cover is open and the box is configured to receive one or more articles therein.

Figure 9:
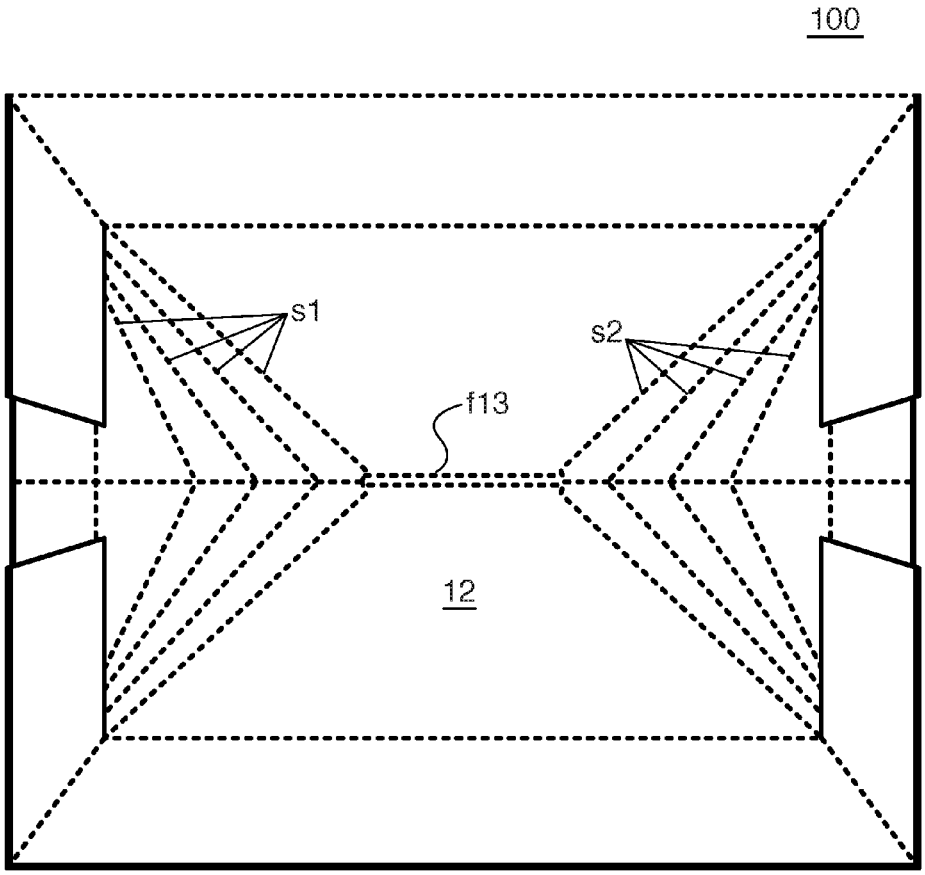
FIG. 9 is a perspective view of the inside of the box looking down at the bottom of the box and perhaps best shows the score lines s1 and s2 and fold line f13 formed in the bottom panel 12.

FIG. 9 is a perspective view of the inside of the box looking down at the bottom of the box and perhaps best shows the score lines s1 and s2 formed in the bottom panel 12.

FIGS. 10 and 11 are perspective views of the assembled box 100 from inside of the box, wherein the cover is open; FIG. 10 is a perspective inside view of the second side of the box 100 and FIG. 11 is a perspective inside view of the first side of the box 100.

It will be appreciated from FIGS. 3-11 that side panels 22,24 overlap with side panel 14 and that side panels 26,28 overlap with side panel 16 when the box 100 is in the assembled state; however, the overlap is such that the side panels 22,24 do not overlap each other and instead are spaced apart, and side panels 26,28 do not overlap each other and instead are spaced apart. Moreover, side panels 22,24 extend above and beyond side panel 14, and side panels 26,28 extend above and beyond side panel 16 when the box 100 is in the assembled state. Consequently, the side panels 22,24 are in spaced relation to each other and define a gap or opening 40 therebetween in extending beyond the side wall 14, and the side panels 26,28 are in spaced relation to each other and define a gap 42 or opening therebetween in extending beyond the side wall 16. It is these openings 40,42 that the top side panels 32,34 extend through, respectively, when the lid is closed.

FIGS. 12-16 illustrate the assembled box 100 when in a collapsed state.

It is believed that the top side panel 32 of the lid extending between the inside and outside of the box inbetween the first pair of spaced side walls 22,24, and the top side panel 34 of the lid extending between the inside and outside of the box inbetween the second pair of spaced side walls 26,28 together create a secure engagement for keeping the box 100 closed and, further, provide greater stacking strength of the box 100 when closed.

Figure 12:
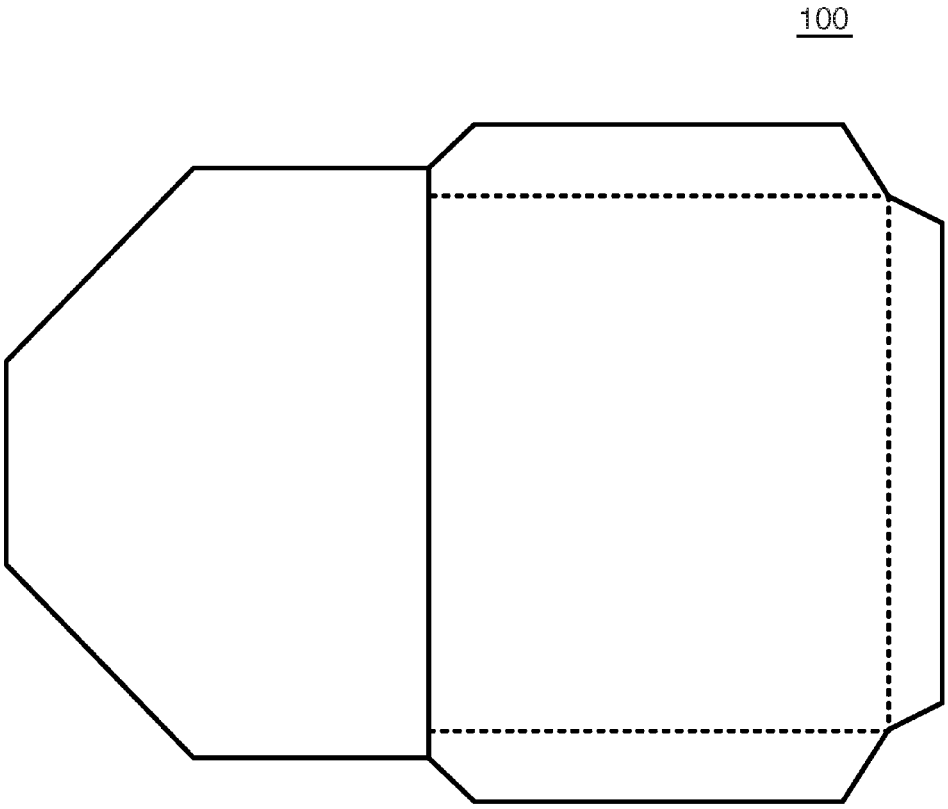
FIG. 12 is a perspective view of the assembled box 100 in a collapsed state, the box 100 having been folded along fold line f13.

Specifically, FIG. 12 is a perspective view of the assembled box 100 in a collapsed state, the box 100 having been folded along fold line f13.

Figure 13:
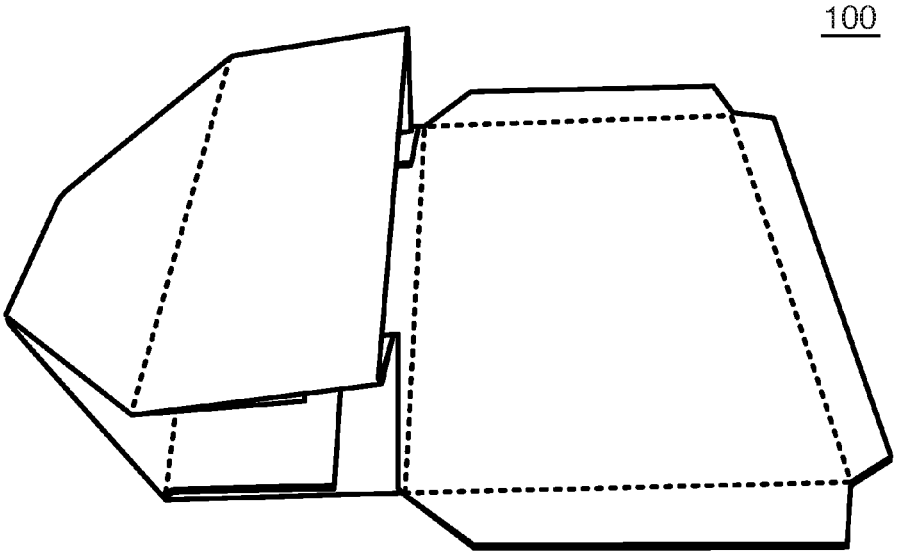
FIG. 13 is a perspective view of the first side of the assembled box 100 in the collapsed state.

FIG. 13 is a perspective view of the first side of the assembled box 100 in the collapsed state.

Figure 14:
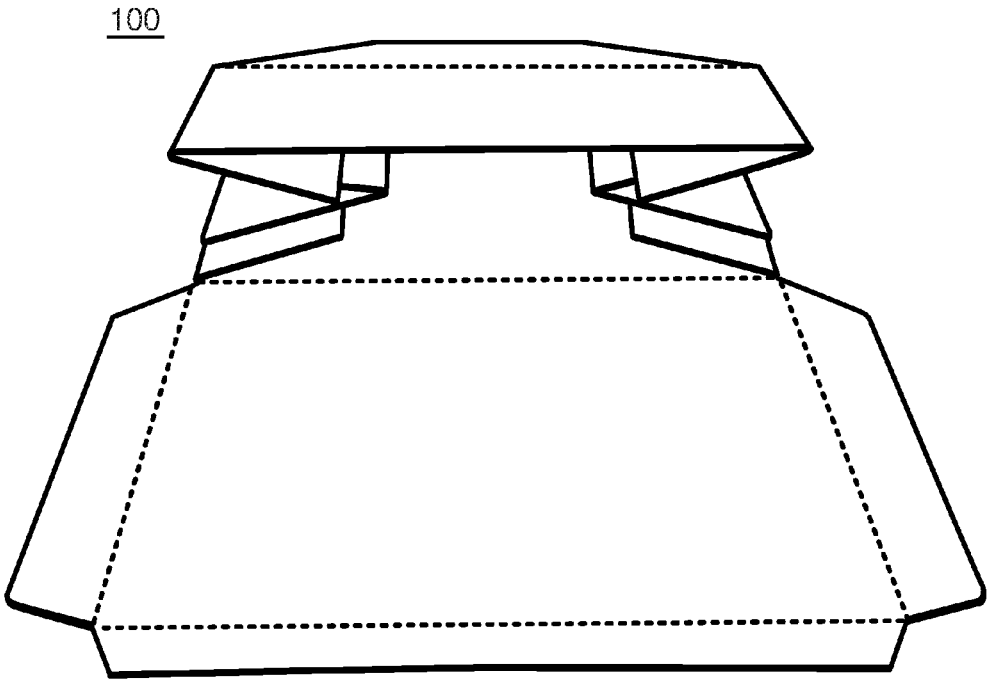
FIG. 14 is a perspective view of the assembled box 100 in the collapsed state with a view into the interior of the box.

FIG. 14 is a perspective view of the assembled box 100 in the collapsed state with a view into the interior of the box.

Figure 15:
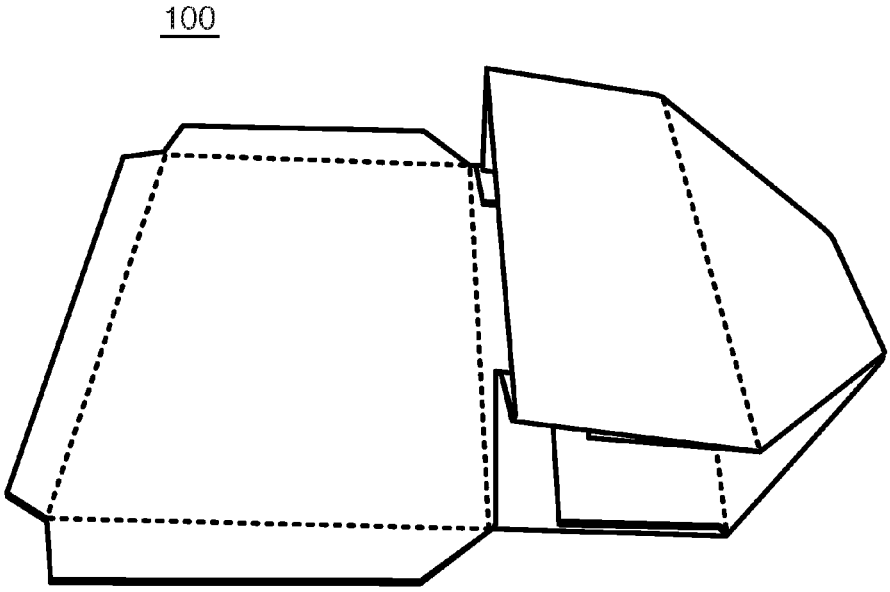
FIG. 15 is a perspective view of the second side of the assembled box 100 in the collapsed state.

FIG. 15 is a perspective view of the second side of the assembled box 100 in the collapsed state.

Figure 16:
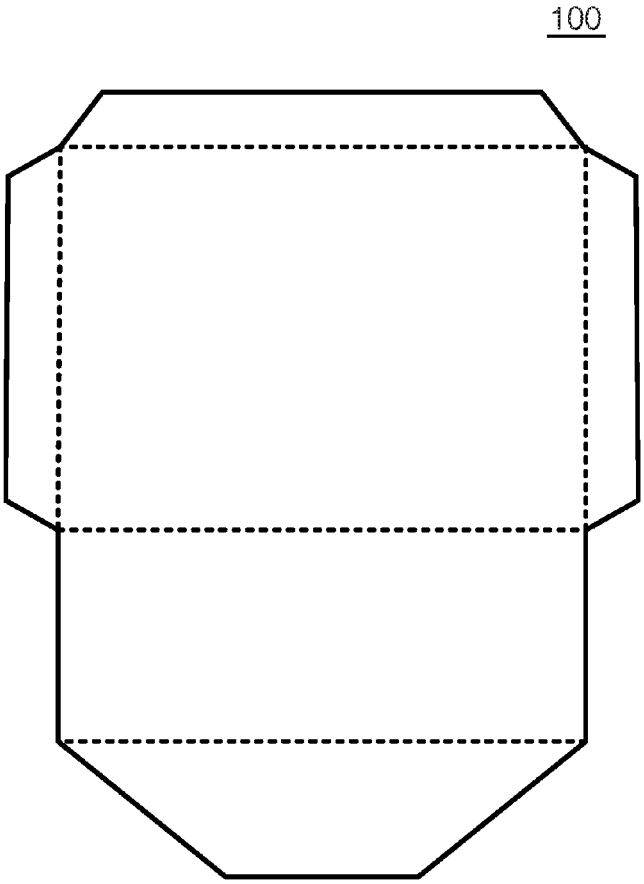
FIG. 16 is another perspective view of the assembled box 100 in a collapsed state.

FIG. 16 is another perspective view of the assembled box 100 in a collapsed state.

Figure 17:
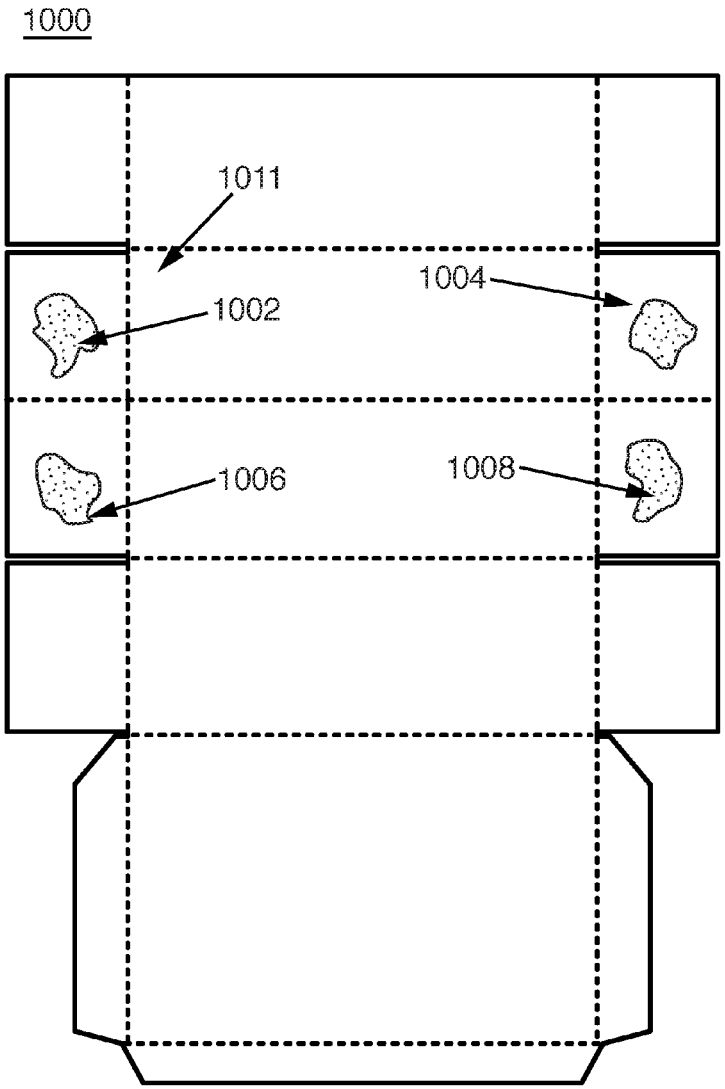
FIG. 17 is a perspective view of the box in a disassembled state, reduced back to a generally planar form, and serves to illustrate areas at which panels are adhered to maintain the assembled box 100 in the assembled state.

FIG. 17 is a perspective view of the box in a disassembled state, reduced back to a generally planar form, and serves to illustrate areas at which panels are adhered to maintain the assembled box 100 in the assembled state.

Figure 18:
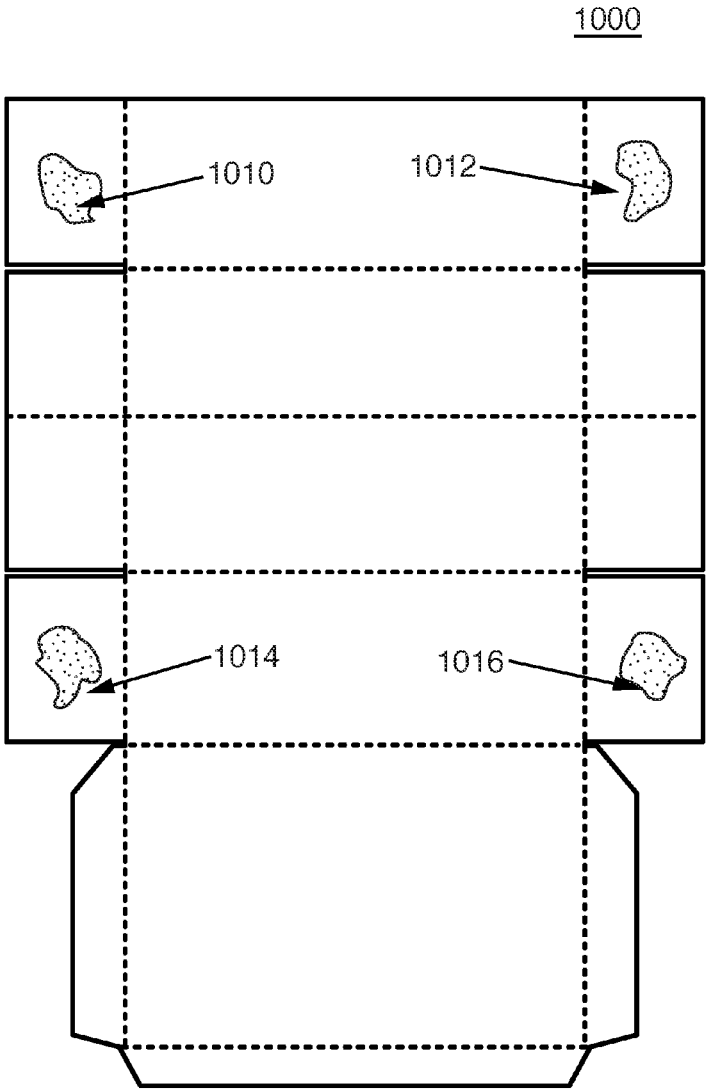
FIG. 18 is a similar view to that of FIG. 17, but of the opposite planar side, and also serves to illustrate areas at which panels are adhered to maintain the assembled box 100 in the assembled state.

FIG. 18 is a similar view to that of FIG. 17, but of the opposite planar side, and also serves to illustrate areas at which panels are adhered to maintain the assembled box 100 in the assembled state. In particular, the assembled box 100 is held in the assembled position with glue or other fastening means that may be conventional. The glued areas are revealed at 1002,1004,1006,1008 in FIG. 17 and at 1010,1012,1014, 1016 in FIG. 18 with reference to the box blank 1000 shown, wherein the assembled box 100 has been pulled apart after being assembled. The single sheet of material preferably is a corrugated cardboard material, as revealed in FIG. 17 wherein at 1011 a portion of the top surface of the sheet of material has been removed to reveal an interior section of the material.

FIGS. 19-24 show a second embodiment of an assembled box 200, wherein the openings defined in the sides of the box extend lower than in the assembled box 100.

Figure 19:
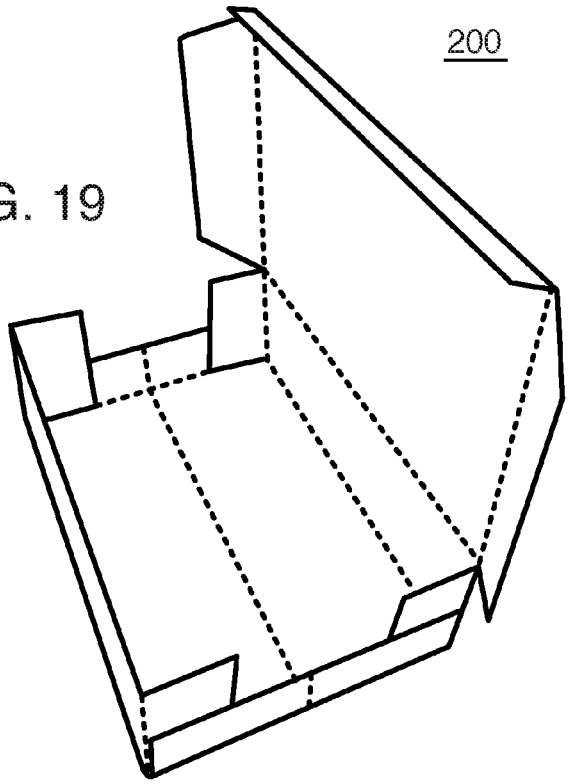
FIG. 19 is a perspective view of the box 200 wherein the cover is open.

Specifically, FIG. 19 is a perspective view of the box 200 wherein the cover is open.

Figure 20:
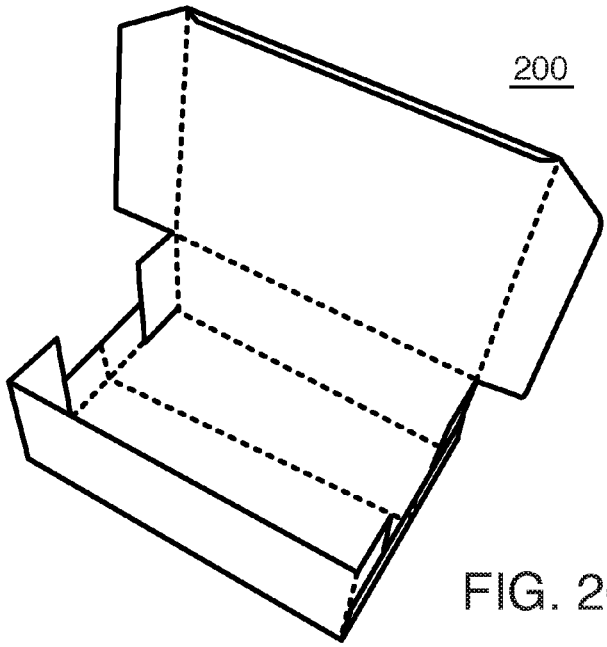
FIG. 20 is another perspective view of the box 200 wherein the cover is open.

FIG. 20 is another perspective view of the box 200 wherein the cover is open.

Figure 21:
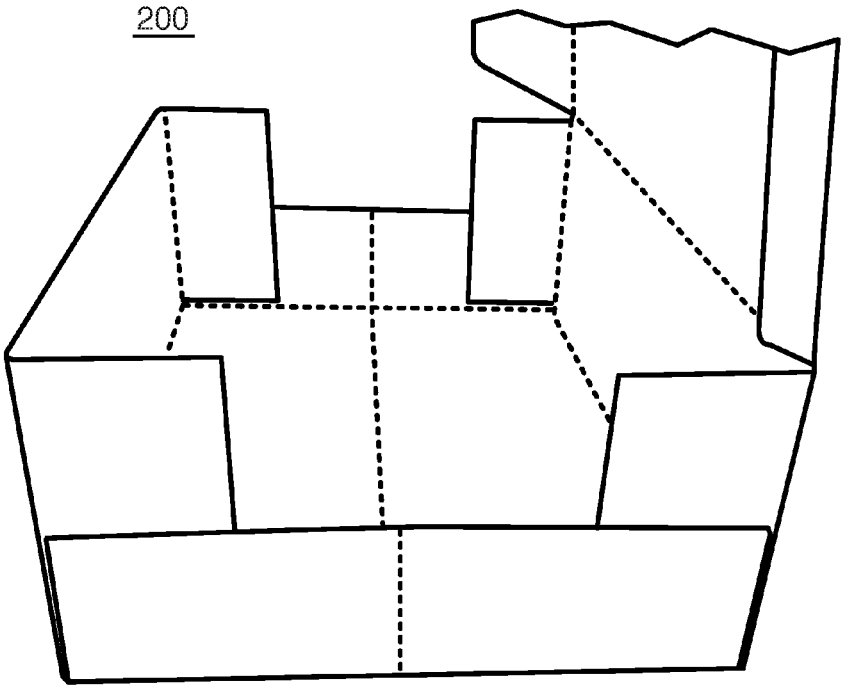
FIG. 21 is a perspective view of a first side of the box 200 wherein the cover is open.

FIG. 21 is a perspective view of a first side of the box 200 wherein the cover is open.

Figure 22:
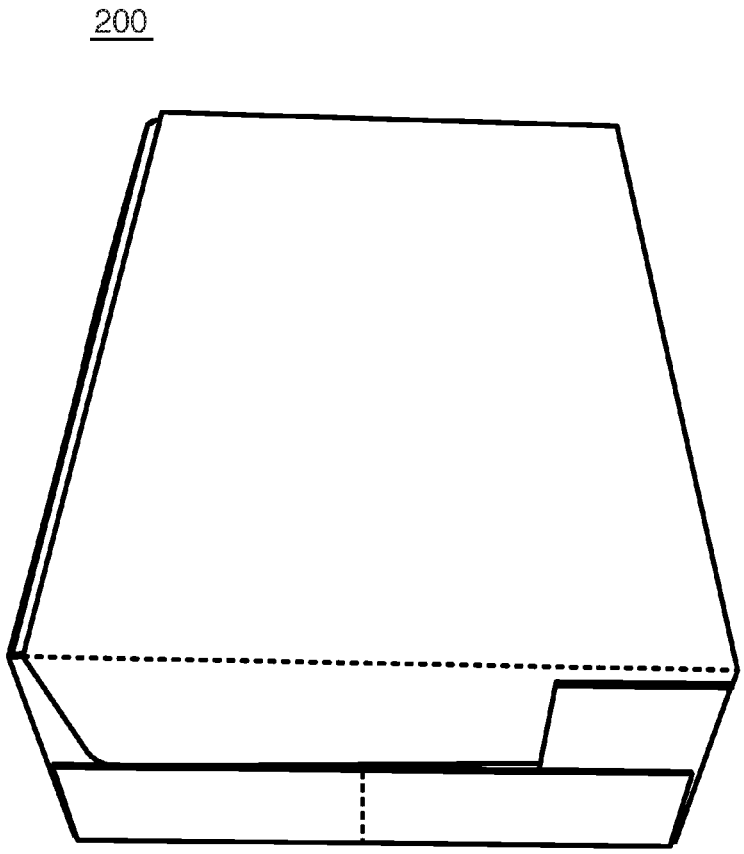
FIG. 22 is a perspective view of the first side of the box 200 wherein the cover is closed.

FIG. 22 is a perspective view of the first side of the box 200 wherein the cover is closed.

Figure 23:
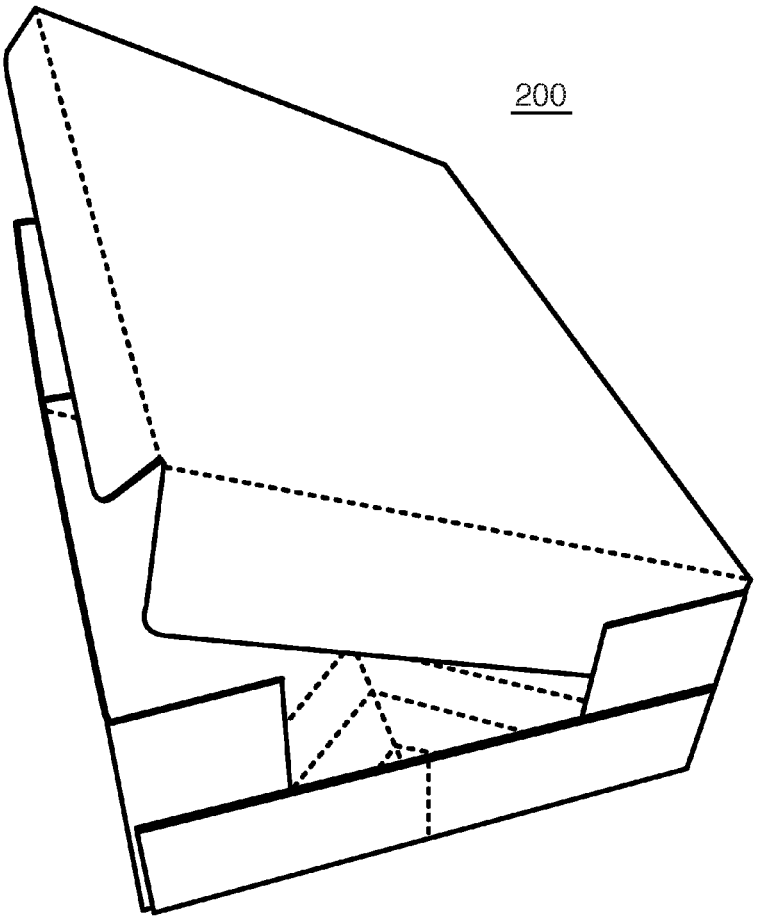
FIG. 23 is perspective view of the first side of the box 200 wherein the cover is partially open.

FIG. 23 is perspective view of the first side of the box 200 wherein the cover is partially open.

Figure 24:
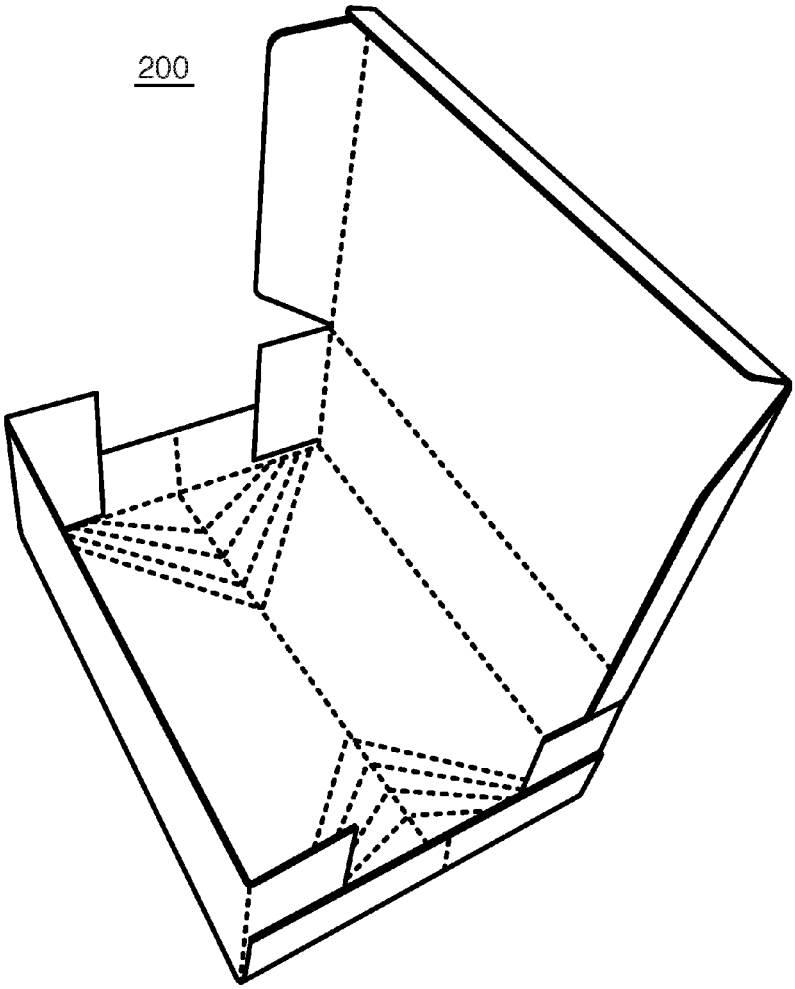
FIG. 24 is perspective view of the first side of the box 200 wherein the cover is open.

FIG. 24 is perspective view of the first side of the box 200 wherein the cover is open.

Figure 25:
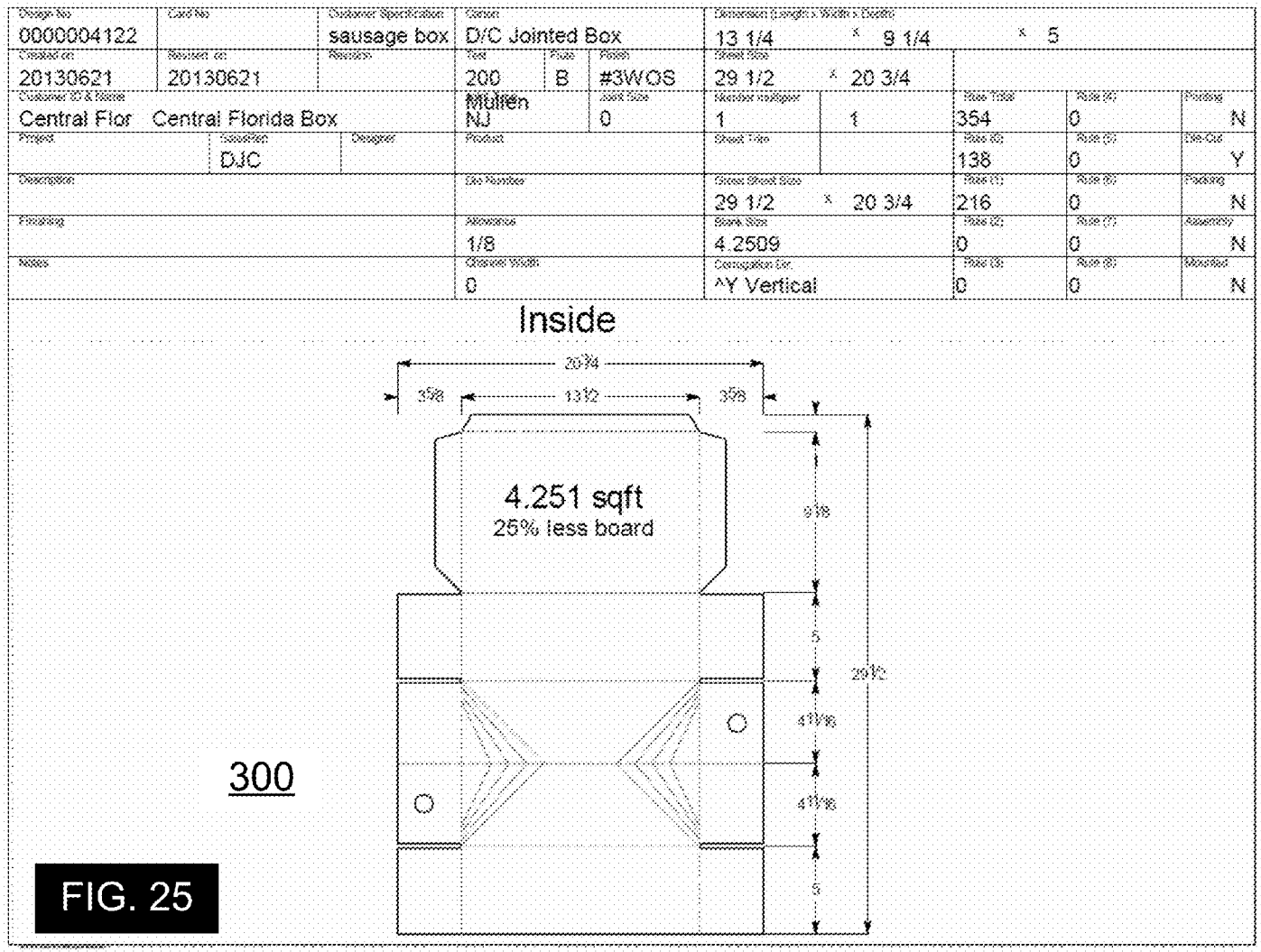
FIG. 25 is a CAD drawing representative of a third embodiment of an assembled box and illustrates a box blank 300.

A third embodiment of an assembled box is represented by the CAD drawing of a box blank 300 in FIG. 25. Fold lines are illustrated, the folding of which forms an assembled box. Furthermore, dimensions are provided for context, are illustrative in nature only, and should not been seen as limiting scope of the broader aspects of the invention.

Vents, while not shown, may optionally be added.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A box formed from folding a single sheet of material having fold lines therein, wherein, when the box is assembled and a top lid of the box is in a closed position, the top lid has top side panels that extend partially within an interior of the box and partially on an exterior of the box, sides of the box defining openings through which the top side panels extend; and wherein, when the box is assembled and the top lid is in the closed position, a first top side panel extends through a first opening in extending between a back and a front of the box, the first top side panel crossing over between an exterior of the box and an interior of the box at the first opening, with the first top side panel extending on the exterior of the box to one side of the first opening and extending on the interior of the box to another side of the first opening in extending between the front and the back of the box; and a second top side panel extends through a second opening in extending between the back and the front of the box, the second top side panel crossing over between the exterior of the box and the interior of the box at the second opening, with the second top side panel extending on the exterior of the box to one side of the second opening and extending on the interior of the box to another side of the second opening in extending between the front and the back of the box.

2. The box of claim 1, wherein the openings defined in the sides of the box are covered by the top side panels when extending therethrough.

3. The box of claim 1, wherein, when the box is assembled and the top lid is in the closed position, the first top side panel extending through the first opening creates tension between the first top side panel and a first side of the box defining the first opening, and the second top side panel extending through the second opening creates tension between the second top side panel and a second side of the box defining the second opening, which tension assists in keeping the box closed.

4. The box of claim 3, wherein, when the box is assembled and the top lid is in the closed position, the first side panel covers the first opening and the second side panel covers the second opening when the box is closed.

5. The box of claim 1, wherein when the box is assembled and the top lid is in an open position, the first opening is bound on three sides with the fourth side being unbounded, and wherein the second opening is bound on three sides with the fourth side being unbounded.

6. The box of claim 1, wherein when the box is assembled and the top lid is in an open position, the first overlapping side panel bounds a first, lateral side of the first opening; the second overlapping side panel bounds a second, lateral side of the first opening;

and the first side panel bounds a third, bottom side of the first opening.

7. The box of claim 6, wherein when the box is assembled and the top lid is in an open position, the third overlapping side panel bounds a first, lateral side of the second opening; the fourth overlapping side panel bounds a second, lateral side of the second opening; and the second side panel bounds a third, bottom side of the second opening.

8. The box of claim 7, wherein when the box is assembled and the top lid is in an open position, the top side of the first opening is unbounded and the top side of the second opening is unbounded.

9. The box of claim 1, wherein each side of the box defining one of the openings is U-shaped in profile.

10. A box blank comprising:

(a) a bottom panel;

(b) a first side panel;

(c) a second side panel;

(d) a front panel;

(e) a back panel;

(f) a first overlapping side panel;

(g) a second overlapping side panel;

(h) a third overlapping side panel;

(i) a fourth overlapping side panel;

(j) a top cover panel;

(k) a first top side panel;

(l) a second top side panel; and (m) a top front panel;

(n) wherein the panels of the box blank are integrally formed as part of a generally planar single sheet of material and are defined and separated by fold lines;

(o) wherein a fold line extends between and delineates the bottom panel and the first side panel; a fold line extends between and delineates the bottom panel and the second side panel; a fold line extends between and delineates the bottom panel and the front panel; a fold line extends between and delineates the bottom panel and the back panel; a fold line extends between and delineates the back panel and the first overlapping side panel; a fold line extends between and delineates the back panel and the third overlapping side panel; a fold line extends between and delineates the front panel and the second overlapping side panel; a fold line extends between and delineates the front panel and the fourth overlapping side panel; a fold line extends between and delineates the top cover panel and the back panel; a fold line extends between and delineates the top cover panel and the first top side panel; a fold line extends between and delineates the top cover panel and the second top side panel; and a fold line extends between and delineates the top cover panel and the top front panel; and (p) wherein, when the box blank is folded along the fold lines into an assembled box for use and is in a closed position, (i) the first overlapping side panel and the second overlapping side panel have dimensions such that the first overlapping side panel and the second overlapping side panel overlap the first side panel but do not overlap each other and instead are spaced apart and extend above the first side panel so as to define a first gap above the first side panel extending between the first overlapping side panel and the second overlapping side panel, (ii) the third overlapping side panel and the fourth overlapping side panel have dimensions such that the third overlapping side panel and the fourth overlapping side panel overlap the second side panel but do not overlap each other and instead are spaced apart and extend above the second side panel so as to define a second gap above the second side panel extending between the third overlapping side panel and the fourth overlapping side panel, (iii) the first top side panel extends through the first gap in extending between the back panel and the front panel, the first top side panel crossing over between an exterior of the box and an interior of the box at the first gap, with the first top side panel extending on the exterior of the box to one side of the first gap and extending on the interior of the box to another side of the first gap, and (iv) the second top side panel extends through the second gap in extending between the back panel and the front panel, the second top side panel crossing over between the exterior of the box and the interior of the box at the second gap with the second top side panel extending on the exterior of the box to one side of the second gap and extending on the interior of the box to the another side of the second gap.

11. The box blank of claim 10, wherein an additional fold line generally bisects the first side panel; an additional fold line generally bisects the second side panel; an additional folding line generally bisects the bottom panel; and score lines are formed in the bottom panel, whereby a box assembled from the blank is collapsible while in the assembled state by folding about the additional fold lines and score lines.

12. The box blank of claim 10, wherein when the box blank is in an unfolded generally planar form, (i) an edge of the first overlapping side panel, an edge of the second overlapping side panel, and an edge of the first side panel are aligned with each other, with the aligned edge of the first overlapping side panel and the aligned edge of the second overlapping side panel each having an extent that is greater than an extent of the aligned edge of the first side panel; and (ii) a second edge of the first overlapping side panel and a second edge of the second overlapping side panel each is orthogonal to the aligned edge of the first side panel, with a combined extent of the second edge of the first overlapping side panel and the second edge of the second overlapping side panel being less than the extent of the aligned edge of the first side panel;

whereby the first gap is defined by the first side panel and the first and second overlapping side panels when the box blank is folded along the fold lines into the assembled box for use.

13. The box blank of claim 12, wherein when the box blank is in an unfolded generally planar form (i) an edge of the third overlapping side panel, an edge of the fourth overlapping side panel, and an edge of the second side panel are aligned with each other, with the aligned edge of the third overlapping side panel and the aligned edge of the fourth overlapping side panel each having an extent that is greater than an extent of the aligned edge of the second side panel; and (ii) a second edge of the third overlapping side panel and a second edge of the fourth overlapping side panel each is orthogonal to the aligned edge of the second side panel, with a combined extent of the second edge of the third overlapping side panel and the second edge of the fourth overlapping side panel being less than the extent of the aligned edge of the second side panel, whereby the second gap is defined by the second side panel and the third and fourth overlapping side panels when the box blank is folded along the fold lines into the assembled box for use.

14. A box comprising a folded box blank, the box blank comprising:

(a) a bottom panel;
(b) a first side panel;
(c) a second side panel;
(d) a front panel;
(e) a back panel;
(f) a first overlapping side panel;
(g) a second overlapping side panel;
(h) a third overlapping side panel;
(i) a fourth overlapping side panel;
(i) a top cover panel;
(k) a first top side panel;
(l) a second top side panel; and
(m) a top front panel;

(n) wherein the panels of the box blank are integrally formed as part of a generally planar single sheet of material and are defined and separated by fold lines;

(o) wherein a fold line extends between and delineates the bottom panel and the first side panel; a fold line extends between and delineates the bottom panel and the second side panel; a fold line extends between and delineates the bottom panel and the front panel; a fold line extends between and delineates the bottom panel and the back panel; a fold line extends between and delineates the back panel and the first overlapping side panel; a fold line extends between and delineates the back panel and the third overlapping side panel; a fold line extends between and delineates the front panel and the second overlapping side panel; a fold line extends between and delineates the front panel and the fourth overlapping side panel; a fold line extends between and delineates the top cover panel and the back panel; a fold line extends between and delineates the top cover panel and the first top side panel; a fold line extends between and delineates the top cover panel and the second top side panel; and a fold line extends between and delineates the top cover panel and the top front panel; and (p) wherein, when the folded box is in a closed position, (i) the first overlapping side panel and the second overlapping side panel overlap the first side panel but do not overlap each other and instead are spaced apart and extend above the first side panel so as to define a first gap above the first side panel extending between the first overlapping side panel and the second overlapping side panel, (ii) the third overlapping side panel and the fourth overlapping side panel overlap the second side panel but do not overlap each other and instead are spaced apart and extend above the second side panel so as to define a second gap above the second side panel extending between the third overlapping side panel and the fourth overlapping side panel, and (iii) the first top side panel extends through the first gap in extending between the back panel and the front panel, the first top side panel crossing over between an exterior of the box and an interior of the box at the first gap, with the first top side panel extending on the exterior of the box to one side of the first gap and extending on the interior of the box to another side of the first gap, and (iv) the second top side panel extends through the second gap in extending between the back panel and the front panel, the second top side panel crossing over between the exterior of the box and the interior of the box at the second gap with the second top side panel extending on the exterior of the box to one side of the second gap and extending on the interior of the box to the another side of the second gap.

15. The box of claim 14, wherein the first top side panel extending through the first gap creates tension between the first top side panel and the first and second overlapping side panels, and the second top side panel extending through the second gap creates tension between the second top side panel and the third and fourth overlapping side panels, which tension assists in keeping the box closed.

16. The box of claim 14, wherein the first side panel covers the first gap and the second side panel covers the second gap when the folded box is in the closed position.

17. The box of claim 14, wherein when the box is open, the first gap is bound on three sides with the fourth side being unbounded, and wherein the second gap is bound on three sides with the fourth side being unbounded.

18. The box of claim 14, wherein the first overlapping side panel bounds a first, lateral side of the first gap; the second overlapping side panel bounds a second, lateral side of the first gap; and the first side panel bounds a third, bottom side of the first gap.

19. The box of claim 18, wherein the third overlapping side panel bounds a first, lateral side of the second gap; the fourth overlapping side panel bounds a second, lateral side of the second gap; and the second side panel bounds a third, bottom side of the second gap.

20. The box of claim 19, wherein when the box is open, the top side of the first gap is unbounded and the top side of the second gap is unbounded.

* * * * *